US005257967A

United States Patent [19]

Gysin

[11] Patent Number: 5,257,967

[45] Date of Patent: Nov. 2, 1993

[54] INKING ROLLERS

[76] Inventor: Max Gysin, 11 Hidden Hill Dr., Babylon, N.Y. 11702

[21] Appl. No.: 982,151

[22] Filed: Nov. 25, 1992

Related U.S. Application Data

[63] Continuation of Ser. No. 645,247, Jan. 24, 1991, abandoned.

[51] Int. Cl.[5] ..... B21B 31/08

[52] U.S. Cl. ..... 492/56; 492/53

[58] Field of Search ..... 492/28, 49, 53, 56, 492/59

[56] References Cited

U.S. PATENT DOCUMENTS

| | | | |
|---|---|---|---|
| 2,088,471 | 7/1937 | Freedlander | 492/56 |
| 2,094,008 | 9/1937 | Freedlander | 492/56 |
| 2,145,418 | 1/1939 | Herchenrider | 492/56 X |
| 2,178,421 | 10/1939 | Freedlander | 29/132 X |
| 2,333,800 | 11/1943 | Lewis et al. | 29/132 |
| 2,450,409 | 10/1948 | Baymiller | 29/132 X |
| 2,594,348 | 4/1952 | Rockoff | 29/132 X |
| 3,139,826 | 7/1964 | Rainwater | 29/132 X |
| 3,152,387 | 10/1964 | MacLeod | 492/56 |
| 3,293,728 | 12/1966 | Hill | 29/132 |
| 3,475,803 | 11/1969 | Hill | 29/132 |
| 3,587,153 | 6/1971 | Blickenderfer, Jr. et al. | 492/56 |
| 3,686,731 | 8/1972 | Koori et al. | 492/56 |
| 3,714,693 | 2/1973 | Peterson | 29/132 |
| 3,724,047 | 4/1973 | Peterson | 29/132 X |
| 3,785,022 | 1/1974 | Bowling et al. | 29/132 |
| 4,198,739 | 4/1980 | Budinger et al. | 29/132 |
| 4,258,089 | 3/1981 | Anderson et al. | 29/132 X |
| 4,368,568 | 1/1983 | Watanabe | 29/132 X |
| 4,550,478 | 11/1985 | Olcott, Jr. | 492/56 |
| 4,887,340 | 12/1989 | Kato et al. | 29/132 X |
| 5,014,406 | 5/1991 | Kato et al. | 29/132 X |

*Primary Examiner*—Timothy V. Eley
*Attorney, Agent, or Firm*—Hopkins & Thomas

[57] ABSTRACT

There is disclosed a roller for evenly distributing and spreading liquid in which the roller includes a roller core having a predetermined durometer hardness mounted thereon and an exterior shell having a durometer hardness different than that of the rubber element bonded to the core.

26 Claims, 1 Drawing Sheet

INKING ROLLERS

This is a continuation of application Ser. No. 07/645,247 filed on 01-24-91 now abandoned.

BACKGROUND OF THE INVENTION

The present invention relates to the construction of an inking roller or the like and to the method of making the same.

Inking rollers, a generic term for rollers adapted to spread liquid such as ink, water, or other solvents, are essential parts of the printing and graphic arts industries. For example, water form Barback rollers are used in the printing industry to spread water over a printing plate as evenly and as thinly as possible. When water and/or other liquids are distributed over a printing plate, it covers those areas of the plate with printing images to which ink is applied for printing, as well as those areas that are free or devoid of printing images and are intended to be free of print. If the water or other liquid is applied and spreads too quickly or too unevenly, printing is adversely affected and the printed image that is produced is often unacceptable.

The problem with the known rollers, for example, lies in the fact that in order to obtain the optimum print performance, the exterior surface of the roller is required to have a certain characteristic (such as hardness, resiliency, and porosity), while the overall radial body of the roller is required to have a different characteristic (particularly hardness) necessary to withstand the forces applied to it by the supporting shaft, and the increased speed relative to the outer surface.

In particular, it is important to provide a roller having an outer or contact surface enabling the uniform spread of the ink and/or other liquid against the counter rollers and print plate, while at the same time providing overall characteristics radially from center to surface to transmit a uniform mechanical pressure on the roller itself.

Various attempts were known to provide rollers having varying characteristics of hardness, resiliency, etc. built into them. In years past, rollers were covered with fabric such as moleskin to provide the desired external surface characteristics or to provide rollers having soft surfaces or by covering a rubber base element with softer rubber materials. See for example U.S. Pat. No. 1,370,709. More recently, more complex constructions were attempted. For example, U.S. Pat. No. 4,750,422, issued to Max Gysin on Jan. 14, 1988, provided a water form roller, having a plurality of helically, interwound rubber compounds of different durometers bonded to form a monolithic roller. Another attempt has been made in U.S. Pat. No. 4,065,841, by Max Gysin, issued Jan. 3, 1978, wherein a roller was manufactured completely of polyvinylchloride (PVC) resin at a preselected hardness to withstand the pressures of printing and where the surface has been mechanically abraded to provide the desired surface characteristics.

However, it has become the industry's standard to provide rollers of rubber and/or elastomeric blends of natural or synthetic rubbers and PVC. Such rollers are blended to provide uniformity in materials and characteristics throughout their depth so as to provide a nominal durometer hardness as well as other characteristics which are somewhat between those desired on the exterior and those desired in the interior. As such, these rollers are produced neither for optimum surface application of liquid nor for optimum strength, durability, or long useful life.

There exists, therefore, the need for a water form roller which does not exhibit the foregoing disadvantages. The present invention fulfills such a need.

It is another object of the present invention to provide a roller having overall nominal characteristics such as hardness and/or resiliency in which the exterior surface of the roller is formed having specifically different characteristics from that of the concentric interior of the roller.

It is a further object to provide a roller having optimum characteristics for liquid application on its exterior surface as well as optimum characteristics in the interior to absorb the shock and strain created by its mounting or its use.

A more specific object of the present invention is to provide a roller formed of a harder, more dense composition of predetermined characteristic on the exterior and a second material of a softer more resilient different set of characteristics in the interior.

These objects, as well as other objects and advantages will be apparent from the following disclosure.

BRIEF STATEMENT OF THE INVENTION

In accordance with the invention, there is provided a roller for application of liquids in printing machines or similar devices having concentric sections of different materials. The roller comprises an annular core of a first elastomeric material having a predetermined or preselected set of characteristics (primarily durometer hardness) and an annular outer shell of a second elastomeric material having a set of characteristics (primarily durometer hardness) different from those of the first material. The core and the outer shell are bonded together so as to provide an integral unitary construction wherein the nominal characteristics of the roller are a combination, e.g. average of the hardness characteristics of each of the first and second materials, although the core and outer shell exhibit distinctly different characteristics from each other.

Preferably, the outer shell is formed of a natural or synthetic rubber compound, while the core is formed of a synthetic plastic resin—namely, polyurethane.

The process of forming the foregoing roller comprises the steps of forming a polyurethane core, applying a concentric rubberized material to the core uniformly, and thereafter completing the curing of two materials simultaneously so as to effect an intimate, co-bonding of the surface molecules together to thereby provide an integral unitary construction.

The details of the present invention are set forth in the following description and illustrated in the accompanying drawings.

DESCRIPTION OF THE PREFERRED EMBODIMENTS

The Roller Construction

Figure 1:
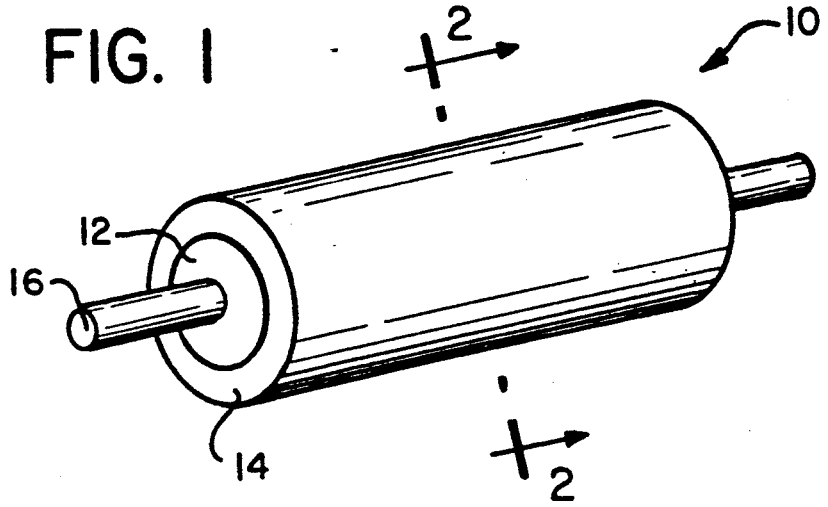
FIG. 1 is a view in perspective of an inking roller according to the present invention.
Figure 2:
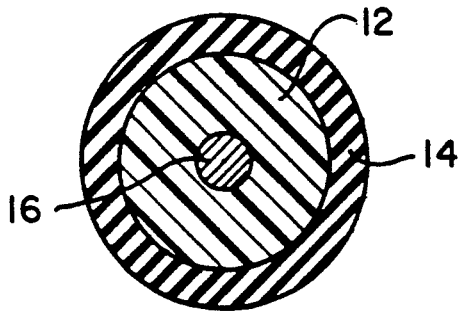
FIG. 2 is a sectional view of the roller shown in FIG. 1, taken through line 2—2 of FIG. 1.

Referring now more particularly to FIG. 1, the roller according to the invention is generally referred to by the numeral 10. The roller 10 comprises a centrally located annular core 12 of a first elastomeric material, about which is provided a second annular shell 14 formed of a second material. The two materials have different sets of predetermined and/or selected characteristics. Essentially, the core 12 comprises a polyurethane composition, while the annular outer shell 14 is a natural or synthetic rubber composition. The roller as used generally is mounted on a metal, steel, or other rigid shaft 16 which is mounted so that the roller is applied to the ink roller, platen, etc. with considerable mechanical force.

In most instances the resin chosen for the outer shell 14 will have characteristics such as having a higher durometer hardness, lower resiliency, and a different water or liquid sorbtive characteristics then the elastomer of the core. The outer shell 14 is preferably relatively thin with respect to the overall thickness of the roller 10. It will be obvious, however, that the relative thickness of the core 12 and outer shell 14 can vary widely so as to provide any desirable exterior and/or interior characteristic, while providing the roller with a uniform nominal overall set of characteristics. The prime characteristics, of course, are the degree of hardness obtained overall diametrically across the roller as well as the degree of hardness of the outer surface of the roller as measured conventionally in this art. Hardness or durometer hardness as referred to herein may be measured in accordance with ASTM D2240-85 or by using the conventional Shore A or Shore B durometers for example.

The overall hardness of the roller is, of course, the arithmetic mean of the hardness of each of the component portions as defined by the statement $dr1+dr2=dt$, where d=durometer; r1 is the radius of the core; r2 is the radius of the cover shell; and t=the total hardness. Thus, a thin cover shell 14 having optimum resiliency, liquid adsorption, and spreadability for its intended purpose may be mounted on a thick core 12 of harder material. Thus, a roller of desired radial nominal durometer hardness of approximately the hardness of the core can be provided. The thin outer shell 14 will hardly influence the strength and durability exhibited by the core 12, while similarly the harder core will not affect the spreadability, sorbtion, or adhesiveness of the outer shell 14. On the other hand, if a softer or lower durometer roll is desired, the outer shell may be enlarged to provide a thicker but softer shell, or the core may be replaced with softer material. Such a construction enables the formation of a roller having selected predetermined optimum characteristics on its surface without sacrificing the hardness and strength of the roller overall. The roller core and exterior element are bonded together as explained more fully hereinbelow so as to provide a unitary integral construction wherein the surface molecules of the interface between the different material become cross-linked and bonded.

The outer shell may be made of a wide variety of elastomers such as natural or synthetic rubbers and blends thereof commonly used in the formation of the known rollers. For example, NBR/PVC rubbers and nitrile rubbers as well as polymeric rubbers such as XNBR polymers and XNBR/PVC polymeric blends may be used. The material will be selected to provide the predetermined operational characteristics of hardness, resiliency, density, etc. Such selection does not require any experimentation since the nature of the elastomeric materials are readily known and/or easily determined by known methods and techniques.

The following compound (given in parts per weight) illustrates the type of rubber compound blend formulation which may be used to advantage in the inventive printing rolls.

| | |
|---|---|
| *KRYNAC NV-866-20 | 280 |
| Paraplex G-25 | 40 |
| Zinc oxide (active) | 3 |
| Titanium dioxide | 5 |
| Cabosil M-7 | 10 |
| Neophax 'A' | 25 |
| Stearic acid | 1 |
| Octamine | 1 |
| MC sulfur | 0.5 |
| MBTS | 1 |
| TMTD | 1 |
| Sulfasan R | 1.5 |
| TEDT | 1 |

*KRYNAC is a compound of 100 parts per weight NBR, 60 parts per weight PVC, and 120 parts per weight DOP.

Polyurethane compositions are the preferred material for the interior element. The following formulation illustrates a polyurethane compound which may be used for the cover layer.

| | |
|---|---|
| Polymer (polyurethane) | 100.1 |
| Stearic acid | 1.0 |
| Santowhite crystals | 2.0 |
| Sunproof wax | 2.0 |
| Struktol 60 NS | 5.0 |
| Antimony trioxode | 5.0 |
| Zinc oxide | 3.0 |
| Zeoloex 23 | 20.0 |
| Santicizer 141 | 25.0 |
| Paraplex G 25 | 15.0 |
| Neophax 'A' | 20.0 |
| Struktol SU 105 | 2.5 |
| MBTS | 1.5 |
| TMTM | 0.25 |

The foregoing formulation has the following characteristics:

| | |
|---|---|
| Compound Properties | |
| Compound viscosity ML 1 + 4 (100 hC) | 9 |
| Mooney scorch time t5 at 125 hC (min) | 25 |
| Vulcanizate Properties | |
| Minutes cured at 165 hC | 8 |
| Hardness, Shore A | 22 |
| Modulus at 100 percent (MPa) | 0.6 |
| Tensile strength (MPa) | 4.4 |
| Elongation (percent) | 600 |

The foregoing were obtained by conventional tests under ASTM Standards, Section 9, Volume 09.01, "Rubber, Natural and Synthetic—General Test Methods."

Polyurethane, as opposed to other synthetics such as PVC, is critical as the polyurethane composition and rubber compositions have been found to be substantially compatible so as to be able to form an integral chemical bond at their interface in a common and simultaneous curing process. Even after curing, the materials retain their individual operative characteristics such as hardness and water adsorption qualities. Polyurethane also has a long operative life, retaining its chemical and physical structure even when subjected to the harshness of printing inks and the like. It was clearly unexpected that a polyurethane core would be capable of being internally bonded to rubber without loss of its own characteristics and provide an integral roller which would not separate or deteriorate easily.

It will, of course, be possible to provide a wide number of blends of rubber as well as of the polyurethane compositions to provide the two materials from which the present rollers are formed, although such blends as shown above must be primarily of their base material, rubber, and polyurethane, respectively.

The Forming Process

In forming the roller, any of the known and conventional processes, methods, and equipment may be adapted. Preferably, the polyurethane compound material forming the core element is extruded from an extrusion machine directly onto a forming mandrel or the steel shaft which has been properly prepared and has a bonding agent or adhesive to enhance the binding of the polyurethane to it. The polyurethane can be applied by hand, calandered, or in strips directly from the extruder and is simply concentrically wrapped around the mandrel or shaft to the desired cross-sectional thickness. It may then be partially cured if desired. The roll, thus formed, may be wrapped in cloth or heat resistant tape and placed in a cure media and allowed to cure to the desired cross linked density. After this partial curing, the roll is allowed to cool, and the polyurethane surface is precision ground to a specific predetermined diameter.

Thereafter, the polyurethane roll is covered with a concentric outer shell of unvulcanized or partially vulcanized rubber matrix using the methods described above. The built-up roll is again covered as before replaced in the cure media where it is allowed to fully vulcanize and cure. It is thereafter cooled and machined to desired size and smoothness.

Curing is accomplished under conventional steam pressure and time parameters, using a peroxide media to saturate the atmosphere of the curing chamber. Generally, a bonding agent or adhesive will not be necessary, although depending upon the specific polyurethane blend and rubber composition, one may be used. Bonding and covalent linking of the two dissimilar materials has been unexpectedly found to result from curing in the peroxide saturated steam atmosphere.

Figure 3:
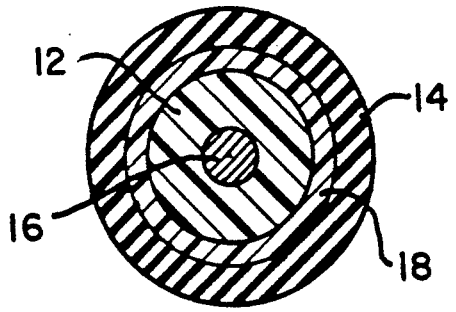
FIG. 3 is a sectional view similar to FIG. 2, taken through another embodiment of the present invention.

Similarly, as shown in FIG. 3, rollers having three concentric sections can be made by interposing an intermediate layer 18 of another type of elastomer between the core 12 and the shell 14. This could further facilitate the manufacture of rollers having exact interior and exterior characteristics.

Utility

Water form rollers have been made in accordance with the present invention and used successfully to distribute and spread liquid over conventional printing surface. In particular, rollers having an outer surface shell 14 as hard as 35 durometer hardness (Shore A) and an interior core with a hardness as low as 15 durometer hardness (Shore A) have been made. Other rollers of varying inner and outer durometers have also been made, each varying between 15 and 35 durometer hardness. Construction of printing rolls with this method allows the use of two different materials in either the same hardness or dissimilar hardness values to obtain less extractability of printing inks, roller wash resistance, solvent resistance, abrasion resistance, improved compression set resistance, improvement in hysteresis, heat buildup, and reduce cost over a conventional roller requiring the entire construction to be of one material. A lower cost factor is obtained than that involved in working with the exotic polymers such as fluoroelastomers.

While the fundamental novel features of this invention, as applied to the preferred embodiment thereof, have been described and shown, it is to be understood that numerous modifications of the invention may be made without departing from the spirit of the invention. It is intended, therefore, that the present invention be limited only as indicated by the scope of the appended claims.

What is claimed is:

1. An inking roller comprising:

(a) a first layer comprising an elastomer having a durometer hardness of approximately 15–35 Shore A; and (b) a second layer comprising polyurethane having a durometer hardness that is different than the durometer hardness of said first layer.

2. The inking roller of claim 1 wherein said first layer and said second layer are bonded together.

3. The inking roller of claim 1 wherein said first layer and said second layer are vulcanized.

4. The inking roller of claim 1 wherein said first layer and said second layer are cross-linked under vulcanization.

5. The inking roller of claim 1 further comprising a metal support shaft.

6. The inking roller of claim 1 wherein said first layer comprises rubber.

7. An inking roller comprising:

(a) a first layer comprising an elastomer having a durometer hardness of approximately 15–35 Shore A; and (b) a second layer comprising polyurethane having a durometer hardness that is greater than the durometer hardness of said first layer.

8. The inking roller of claim 7 wherein said first layer and said second layer are bonded together.

9. The inking roller of claim 7 wherein said first layer and said second layer are vulcanized.

10. The inking roller of claim 7 wherein said first layer and said second layer are cross-linked under vulcanization.

11. The inking roller of claim 7 further comprising a metal support shaft.

12. The inking roller of claim 7 wherein said first layer comprises rubber.

13. An inking roller comprising:

(a) an inner layer comprising an elastomer having a durometer hardness of approximately 15–35 Shore A; and (b) an outer layer comprising polyurethane having a durometer hardness that is greater than the durometer hardness of said inner layer.

14. The inking roller of claim 13 wherein said inner layer and said outer layer are bonded together.

15. The inking roller of claim 13 wherein said inner layer and said outer layer are vulcanized.

16. The inking roller of claim 13 wherein said inner layer and said outer layer are cross-linked under vulcanization.

17. The inking roller of claim 13 further comprising a metal support shaft.

18. The inking roller of claim 13 wherein said inner layer comprises rubber.

19. An inking roller comprising:

(a) an inner layer comprising polyurethane having a durometer hardness of approximately 15–35 Shore A;

(b) an outer layer comprising an elastomer having a durometer hardness that is greater than the durometer hardness of said inner layer.

20. The inking roller of claim 19 wherein said inner layer and said outer layer are bonded together.

21. The inking roller of claim 19 wherein said inner layer and said outer layers are vulcanized.

22. The inking roller of claim 19 wherein said inner layer and said outer layer are cross-linked under vulcanization.

23. The inking roller of claim 19 further comprising a metal support shaft.

24. The inking roller of claim 19 wherein said inner layer comprises rubber.

25. An inking roller comprising:

(a) a first layer comprising an elastomer having a durometer hardness of approximately 15–35 Shore A;

(b) a second layer comprising an elastomer having a durometer hardness of approximately 15–35 Shore A; and (c) a third layer comprising polyurethane having a durometer hardness that is greater than the durometer hardness of said first layer.

26. The inking roller of claim 25 wherein said second layer is an elastomer selected from the group of consisting rubber and polyurethane.

* * * * *

US005257967B1

REEXAMINATION CERTIFICATE (2689th)

United States Patent [19]

Gysin

[11] B1 5,257,967

[45] Certificate Issued Oct. 3, 1995

[54] INKING ROLLERS

[75] Inventor: Max Gysin, Babylon, N.Y.

[73] Assignee: Diamond Roller Corporation, Marietta, Ga.

Reexamination Request
No. 90/003,555, Aug. 26, 1994

Reexamination Certificate for:

| | |
|---|---|
| Patent No.: | **5,257,967** |
| Issued: | **Nov. 2, 1993** |
| Appl. No.: | **982,151** |
| Filed: | **Nov. 25, 1992** |

Related U.S. Application Data

[63] Continuation of Ser. No. 645,247, Jan. 24, 1991, abandoned.

[51] Int. Cl.[6] ..... B21B 31/08

[52] U.S. Cl. ..... 492/56; 492/53

[58] Field of Search ..... 492/28, 49, 53, 492/56, 59

[56] References Cited

U.S. PATENT DOCUMENTS

| | | | |
|---|---|---|---|
| 2,054,620 | 9/1936 | Freedlander | 101/217 |
| 2,099,024 | 11/1937 | Lewis | 154/54.5 |
| 2,230,289 | 2/1941 | Dodge | 18/59 |
| 2,598,167 | 5/1952 | Hill | 154/43 |
| 2,741,014 | 4/1956 | Hubbard | 29/130 |
| 3,046,172 | 7/1962 | Reid | 154/46 |
| 3,147,698 | 9/1964 | Ross | 101/149.2 |
| 3,285,799 | 11/1966 | Peterson | 161/93 |
| 3,293,728 | 12/1966 | Hill | 29/132 |
| 3,467,009 | 9/1969 | Ross | 101/216 |
| 3,594,255 | 7/1971 | Budinger | 156/425 |
| 3,597,297 | 8/1971 | Buchholtz et al. | 161/21 |
| 3,676,282 | 7/1972 | Volmer | 161/87 |
| 3,685,443 | 8/1972 | Küsters | 492/56 X |
| 3,707,752 | 1/1973 | Brafford et al. | 29/132 |
| 3,730,794 | 5/1973 | Ross | 156/112 |
| 3,887,750 | 6/1975 | Duckett et al. | 428/297 |
| 3,902,845 | 9/1975 | Murphy | 432/60 |
| 3,959,573 | 5/1976 | Eddy et al. | 428/425 |
| 3,991,255 | 11/1976 | Blaskiewiez et al. | 428/425 |
| 4,037,299 | 7/1977 | Smith | 29/130 |
| 4,058,879 | 11/1977 | Lentz et al. | 29/132 |
| 4,062,812 | 12/1977 | Safford et al. | 252/500 |
| 4,078,286 | 3/1978 | Takiguichi et al. | 29/132 |
| 4,276,341 | 6/1981 | Tanaka | 428/246 |
| 4,287,649 | 9/1981 | Kohler | 29/130 |
| 4,294,187 | 10/1981 | Fogle | 118/244 |
| 4,313,981 | 2/1982 | Namiki | 427/409 |
| 4,317,265 | 3/1982 | Chase eet al. | 29/132 |
| 4,359,938 | 11/1982 | Koren | 101/148 |
| 4,364,313 | 12/1982 | Hyllberg | 101/401.1 |
| 4,365,000 | 12/1982 | Muller et al. | 428/423.9 |
| 4,378,622 | 4/1983 | Pinkston et al. | 29/148.4 |
| 4,493,256 | 1/1985 | Hyllberg et al. | 101/216 |
| 4,513,660 | 4/1985 | Brands et al. | 101/1 |
| 4,522,866 | 6/1985 | Nishikawa et al. | 492/56 X |
| 4,552,816 | 11/1985 | Spahie et al. | 428/420 |
| 4,566,162 | 1/1986 | Brands | 26/106 |
| 4,635,550 | 1/1987 | Brands et al. | 101/415.1 |
| 4,666,782 | 5/1987 | Tada et al. | 428/423.9 |
| 4,697,511 | 10/1987 | Davis et al. | 100/37 |
| 4,756,065 | 7/1988 | Carlson | 29/132 |
| 4,770,928 | 9/1988 | Gaworowski et al. | 428/284 |
| 4,842,944 | 6/1989 | Kuge et al. | 428/451 |
| 4,913,048 | 4/1990 | Tittgemeyer | 101/141 |
| 5,092,235 | 3/1992 | Rise | 100/168 |
| 5,169,450 | 12/1992 | Opad et al. | 118/621 |
| 5,175,053 | 12/1992 | Polston et al. | 428/379 |
| 5,178,071 | 1/1993 | Hyllberg | 101/489 |
| 5,206,992 | 5/1993 | Carlson et al. | 492/56 X |
| 5,206,992 | 5/1993 | Carlson et al. | 29/895 |
| 5,256,459 | 10/1993 | Carlson | 428/36.3 |
| 5,304,267 | 4/1994 | Vrotacoe et al. | 156/86 |

FOREIGN PATENT DOCUMENTS

| | | | |
|---|---|---|---|
| 513684 | 6/1955 | Canada . | |
| 1400932 | 7/1975 | Germany | B41F 29/02 |
| 55-50280-A | 4/1980 | Japan | G03G 15/10 |
| 1198863 | 7/1970 | United Kingdom | B41C 1/02 |
| 1327758 | 8/1973 | United Kingdom | B41F 29/02 |

OTHER PUBLICATIONS

Designation D 1565–81 (1990) Flexible Cellular Materials—Vinyl Chloride Polymers and Copolymers (Open–Cell Foam).

Article entitled "*Kodak Approval Catalyst For New Arcon Inventory Program*", *American Roller Journal*, Dec., 1984.

Designation D 2240–86 Standard Test Method For Rubber Property—Durometer Hardness.

ANSI/ASTM D 1056–78 Standard Specification for Flexible Cellular Materials—Sponge or Expanded Rubber.

Technical Seminar—handout published at Seminar Mar. 25 & 26, 1985.

*Primary Examiner*—Timothy V. Eley

[57] ABSTRACT

There is disclosed a roller for evenly distributing and spreading liquid in which the roller includes a roller core having a predetermined durometer hardness mounted thereon and an exterior shell having a durometer hardness different than that of the rubber element bonded to the core.

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 4, 10, 16, 22, 25 and 26 is confirmed.

Claims 1-3, 5-9, 11-15, 17-21, 23 and 24 are cancelled.

* * * * *